US011146890B2

(12) United States Patent
Bock et al.

(10) Patent No.: US 11,146,890 B2
(45) Date of Patent: Oct. 12, 2021

(54) METHOD FOR SIMULTANEOUSLY OPERATING A LOUDSPEAKER ASSEMBLY IN A LOUDSPEAKER FUNCTION AND IN A MICROPHONE FUNCTION, AND LOUDSPEAKER ASSEMBLY

(71) Applicant: AUDI AG, Ingolstadt (DE)

(72) Inventors: Florian Bock, Nuremberg (DE); Lars Hinrichsen, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 17/274,731

(22) PCT Filed: May 28, 2019

(86) PCT No.: PCT/EP2019/063823

§ 371 (c)(1),
(2) Date: Mar. 9, 2021

(87) PCT Pub. No.: WO2020/052820

PCT Pub. Date: Mar. 19, 2020

(65) Prior Publication Data

US 2021/0250692 A1 Aug. 12, 2021

(30) Foreign Application Priority Data

Sep. 11, 2018 (DE) ..... 10 2018 215 411.2

(51) Int. Cl.
*H04R 3/00* (2006.01)
*H04R 9/02* (2006.01)
(Continued)

(52) U.S. Cl.
CPC ..... *H04R 9/025* (2013.01); *H04R 3/005* (2013.01); *H04R 9/04* (2013.01); *H04R 9/06* (2013.01);
(Continued)

(58) Field of Classification Search
CPC ..... H04R 3/005; H04R 9/025; H04R 9/04; H04R 9/06; H04R 9/08; H04R 19/02;
(Continued)

(56) References Cited

U.S. PATENT DOCUMENTS 4,956,868 A * 9/1990 Carlson ..... H04R 11/00 381/189
10,506,336 B1 * 12/2019 Lesso ..... H04R 29/001
(Continued)

FOREIGN PATENT DOCUMENTS

DE 744088 A 1/1944
DE 856752 B 11/1952
(Continued)

OTHER PUBLICATIONS

International Preliminary Report on Patentability directed to related International Patent Application No. PCT/EP2019/063823, dated Mar. 9, 2021, with attached English-language translation; 14 pages.
(Continued)

*Primary Examiner* — Huyen D Le
(74) *Attorney, Agent, or Firm* — Sterne, Kessler. Goldstein & Fox P.L.L.C.

(57) ABSTRACT

The present disclosure relates to a method for simultaneously operating a loudspeaker assembly in a loudspeaker function and in a microphone function. The loudspeaker assembly comprises a coil, which is movably mounted in the magnetic field of a magnet, and a diaphragm, which is mechanically coupled to the coil, wherein the magnet produces a magnetic flux density (B), the coil, has an effective length in the magnetic field, and the diaphragm has an area (A). In order to determine a first transfer function $Z_M$, a first calibration state is set, in which an external sound pressure (p) on the diaphragm is equal to zero. In order to determine a second transfer function $Z_C$, a second calibration state is
(Continued)

Figure 1:
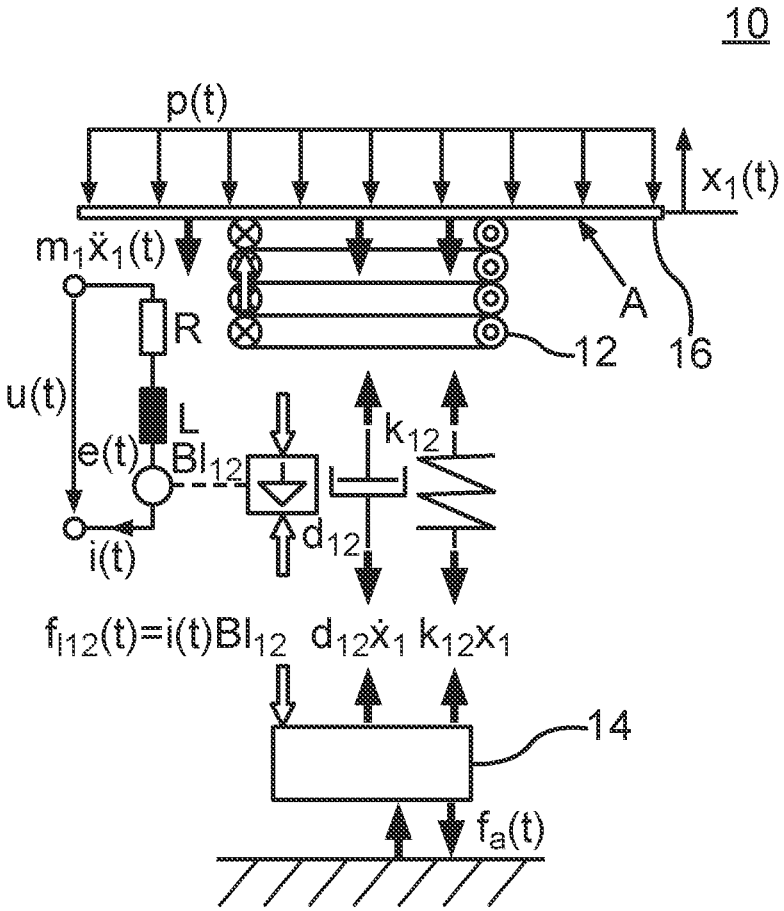

set, in which movement of the diaphragm is suppressed. Subsequently, in normal operation the current (I) flowing through the coil and the voltage (U) dropping across the coil are measured and the external sound pressure (p) on the diaphragm is determined using the magnetic flux density (B), the effective length of the coil in the magnetic field of the magnet, the first transfer function, the second transfer function, the area (A) of the diaphragm, the current (I) measured by the measuring device in normal operation, and the voltage (U) measured by the measuring device in normal operation. The present disclosure further relates to a corresponding loudspeaker assembly.

6 Claims, 1 Drawing Sheet

(51) Int. Cl.

| | |
|---|---|
| ***H04R 9/04*** | (2006.01) |
| ***H04R 9/08*** | (2006.01) |
| ***H04R 9/06*** | (2006.01) |
| ***H04R 29/00*** | (2006.01) |

(52) U.S. Cl.
CPC ..... *H04R 9/08* (2013.01); *H04R 29/003* (2013.01); *H04R 29/004* (2013.01); *H04R 2400/01* (2013.01); *H04R 2499/13* (2013.01)

(58) Field of Classification Search
CPC .... H04R 19/04; H04R 29/003; H04R 29/004; H04R 2400/01; H04R 2499/13
See application file for complete search history.

(56) References Cited

U.S. PATENT DOCUMENTS

| | | | | |
|---|---|---|---|---|
| 2003/0118201 | A1 | 6/2003 | Leske et al. | |
| 2010/0166206 | A1 | 7/2010 | Macours | |
| 2014/0270312 | A1* | 9/2014 | Melanson ..... | H04R 3/005 381/365 |
| 2017/0366898 | A1 | 12/2017 | Melanson et al. | |

FOREIGN PATENT DOCUMENTS

| | | | |
|---|---|---|---|
| DE | 20013346 | U1 | 11/2000 |
| DE | 102005058175 | A1 | 6/2007 |
| EP | 3185244 | A1 | 6/2017 |

OTHER PUBLICATIONS

International Search Report and Written Opinion of the International Searching Authority directed to related International Patent Application No. PCT/EP2019/063823, dated Aug. 9, 2019, with attached English-language translation; 21 pages.

* cited by examiner

METHOD FOR SIMULTANEOUSLY OPERATING A LOUDSPEAKER ASSEMBLY IN A LOUDSPEAKER FUNCTION AND IN A MICROPHONE FUNCTION, AND LOUDSPEAKER ASSEMBLY

TECHNICAL FIELD

The present disclosure relates to a method for simultaneously operating a loudspeaker assembly in a loudspeaker function and in a microphone function. The loudspeaker assembly includes a coil, which is movably mounted in the magnetic field of a magnet, and a diaphragm, which is mechanically coupled to the coil, wherein the magnet produces a magnetic flux density, the coil has an effective length in the magnetic field, and the diaphragm has an area. It also relates to a loudspeaker assembly which includes a coil, which is movably mounted in the magnetic field of a magnet, and a diaphragm, which is mechanically coupled to the coil, wherein the magnet is designed to generate a magnetic flux density, the coil has an effective length in the magnetic field, and the diaphragm has an area.

BACKGROUND

It is known to measure sound events in the air, for example noises, with the aid of microphones. For example, an ANC (active noise cancellation) requires not only loudspeakers as actuators for generating the counter-sound but also microphones as sensors for detecting the sound field, which can at best be canceled by a control loop. Loudspeakers and microphones are also provided as separate independent components in mobile phones.

DE 10 2005 058 175 A1 discloses a loudspeaker assembly for sound reinforcement in a motor vehicle, the loudspeaker also being used as a microphone. The loudspeaker can be used in one position as a microphone and/or as an acoustic damping element; in another position, in addition to its sound radiation function, it can also be used simultaneously as an image projection surface for visual infotainment applications. This document does not propose to use a loudspeaker in a loudspeaker function and in a microphone function simultaneously.

DE 200 13 346 Ul discloses a loudspeaker assembly in a driver's cabin, in which it is proposed to use at least one of the loudspeakers as a microphone for speech input.

This document does not propose to use the loudspeaker assembly in a loudspeaker function and in a microphone function simultaneously either.

EP 3 185 244 A1 describes a speech recognition system with a microphone and at least one loudspeaker which is used as a microphone. However, in this document too, the loudspeaker is used either in the loudspeaker function or in the microphone function thereof, but not simultaneously in both functions.

In order to simultaneously provide a loudspeaker function and a microphone function, further components are therefore required in addition to the loudspeakers, in particular microphones, microphone amplifiers, devices for signal conditioning, lines, and the like. This results in higher costs, additional weight, and additional installation space requirements.

BRIEF DESCRIPTION OF THE DRAWINGS/FIGURES

Figure 2:
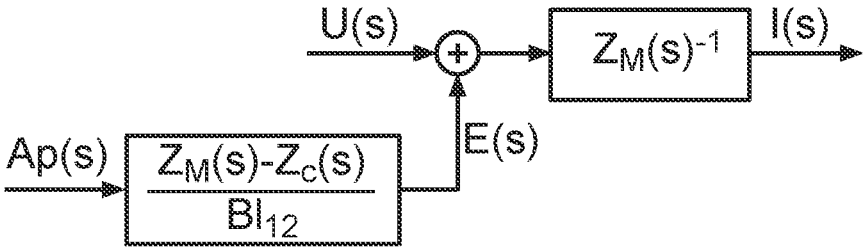

FIG. 1 is a schematic representation of a loudspeaker assembly according to the present disclosure; and FIG. 2 is a signal flow graph for the representation of a mapping function within the scope of the method according to the present disclosure.

DETAILED DESCRIPTION

The object of the present disclosure is to provide simultaneously a loudspeaker function and a microphone function with a reduced installation space requirement, reduced weight, and the lowest possible costs.

This object is achieved by a method and by a loudspeaker assembly, as exemplified by the claims.

The present disclosure is based on the knowledge that a skillful analysis of the conditions in a loudspeaker assembly opens up the possibility of operating the loudspeaker assembly simultaneously in a loudspeaker function and in a microphone function. The loudspeaker simultaneously serves as a measuring device, i.e., as a sensor, and as a conventional loudspeaker, i.e., as an actuator.

In order to make the following statements easier to understand, reference signs are already used at this point, which will be discussed in greater detail below with reference to FIG. 1.

In the disclosed method for simultaneously operating a loudspeaker assembly in a loudspeaker function and in a microphone function—the loudspeaker assembly includes a coil, which is movably mounted in the magnetic field of a magnet, and a diaphragm, which is mechanically coupled to the coil, wherein the magnet produces a magnetic flux density B, the coil has an effective length $l_{12}$ in the magnetic field, and the diaphragm has an area A—the external sound pressure p acting on the diaphragm is determined in the microphone function as follows:

Step (a): setting a first calibration state in which an external sound pressure p on the diaphragm is equal to zero, and measuring a current I flowing into the coil and a voltage U dropping across the coil;

Step (b): from the measured values from step (a): determining a first transfer function $Z_M$=U/I;

Step (c): setting a second calibration state in which movement of the diaphragm is suppressed, and measuring a current I flowing into the coil and a voltage U dropping across the coil;

Step (d): from the measured values from step (c): determining a second transfer function $Z_C$=U/I;

Step (e): in normal operation, measuring the current I flowing through the coil and the voltage U dropping across the coil; and Step (d): determining the external sound pressure p on the diaphragm 16 using the magnetic flux density B, the effective length $I_{12}$ of the coil 12 in the magnetic field of the magnet 14, the first transfer function $Z_M$, the second transfer function $Z_C$, the area A of the diaphragm 16, the current I measured in step (e), and the voltage U measured in step (e).

A loudspeaker function and a microphone function can be implemented simultaneously by a method according to the present disclosure and by a loudspeaker assembly according to the present disclosure, so that a separate microphone can be dispensed with. This results in a reduction in the installation space required, in costs, in weight, and in the amount of wiring and connections. A one-time calibration, for example at the factory, is sufficient to determine the relevant transfer functions.

A preferred embodiment is characterized in that the sound pressure p on the diaphragm 16 is calculated according to $$p=(B*l_{12}*(Z_M*I-U))/(A*(Z_M-Z_C)),$$

B standing for the magnetic flux density generated by the magnet 14, $l_{12}$ for the effective length of the coil 12 in the magnetic field of the magnet 14, A for the area of the diaphragm 16, I for the current measured in step (e) and U for the voltage measured in step (e).

In some aspects the first and second transfer functions are determined as a function of frequency. The current measurement and voltage measurement in steps (a), (c), and (e) preferably take place in a frequency-dependent manner.

In some aspects, steps (a) to (d) of the disclosed method are repeated after the loudspeaker assembly has been installed in an operating environment, in particular at predeterminable time intervals or in response to a user input. This takes into account the fact that, depending on the operating environment (i.e., the installation location) different damping effects and reflections can occur, which lead to different frequency responses of the transfer functions compared to the values determined at the factory. In this way, an adjustment based on aging effects, different temperatures, or air humidity can also be achieved. Because the calibration is performed in the operating environment, the method according to the present disclosure can thus be optimized, which results in particularly low-distortion reproduction of the loudspeaker signals and low-distortion recording of microphone signals.

The present disclosure also relates to a loudspeaker assembly which includes a coil, which is movably mounted in the magnetic field of a magnet, and a diaphragm, which is mechanically coupled to the coil, wherein the magnet is designed to generate a magnetic flux density B, the coil has an effective length $l_{12}$ in the magnetic field, and the diaphragm has an area A. A loudspeaker assembly according to the present disclosure further includes a storage device in which a first transfer function $Z_M$ and a second transfer function $Z_C$ are stored. The loudspeaker assembly also includes a measuring device which is designed to measure a current I flowing into the coil and a voltage U dropping across the coil. The loudspeaker assembly also includes a computing device which is designed to calculate the external sound pressure p on the diaphragm 16 in a microphone function that is performed simultaneously with a loudspeaker function of the loudspeaker assembly using the magnetic flux density B, the effective length $l_{12}$ of the coil 12 in the magnetic field of the magnet 14, the first transfer function $Z_M$, the second transfer function $Z_C$, the area A of the diaphragm 16, the current I measured by the measuring device, and the voltage U measured by the measuring device.

In some aspects, the method disclosed herein offers various advantages for a loudspeaker assembly according to the present disclosure. In particular, the loudspeaker assembly can have a calibration device which is designed to repeatedly carry out steps (a) to (d). In this context, it can be provided that a predeterminable time interval is stored in the storage device, in which the calibration is repeated. In this context, the loudspeaker assembly preferably includes a time measurement device, a control device being provided which is designed to repeat the calibration steps for determining both transfer functions at the time intervals stored in the storage device, the computing device being designed to calculate the external sound pressure on the diaphragm to access the currently determined transfer functions. Alternatively, a manual operating device can be provided in order to manually trigger a calibration process by a user.

FIG. 1 shows a schematic representation of a loudspeaker assembly 10 with a coil 12 which is movably mounted in the magnetic field of a magnet 14. The loudspeaker assembly 10 includes a diaphragm 16 which is mechanically coupled to the coil 12. The magnet 14 generates a magnetic flux density B. The coil 12 has an effective length $l_{12}$ in the magnetic field of the magnet 14. The diaphragm 16 has an area A.

The representation of FIG. 1 shows the variables for a mechanical circuit that can be defined in the loudspeaker assembly, see FIG. 1 on the right, and an electrical circuit, see FIG. 1 on the left.

The following analysis is based on the following equation for a mass oscillator:

$$-m_1\ddot{x}_1-d_{12}\dot{x}_{12}x_1+f_{l12}(t)-Ap(t)=0.$$

In which:

$x_1$ is the displacement of the combination of diaphragm 16 and coil 12 in the magnetic field of the magnet 14;

$\dot{x}_1$ is the speed of the combination of diaphragm 16 and coil 12;

$\ddot{x}_1$ is the acceleration of the combination of diaphragm 16 and coil 12;

$m_1$ is the mass of the combination of diaphragm 16 and coil 12;

$d_{12}$ is a damping property due to a resilient mounting of the combination of diaphragm 16 and coil 12;

$k_{12}$ is the rigidity of this mounting, i.e. the ability to bring the combination of diaphragm 16 and coil 12 back into the starting position;

$f_{1/12}(t)$ is the Lorentz force;

A is the area of the diaphragm 16; and p(t) is the external sound pressure on the diaphragm 16.

The following applies for the Lorentz force:

$$f_{l12}(t)=i(t)Bl_{12}.$$

Accordingly, the Lorentz force arises in that a current i(t) flows through the coil 12 arranged in the magnetic field of the magnet 14. This equation describes the loudspeaker function of the loudspeaker assembly.

With regard to the microphone function, the following equations are relevant:

First, the electromotive force e(t), which results from the operation of the diaphragm 12 in the microphone function:

$$e(t)=Bl_{12}\dot{x}_1(t).$$

The following equation can be configured from the electrical circuit using the mesh theorem:

$$L\frac{di(t)}{dt}+Ri(t)-u(t)+e(t)=0.$$

In which:

L is the inductance of the coil 12;

R is the ohmic resistance of the coil 12;

u(t) is a voltage applied to the coil 12; and i(t) is a current flowing through the coil 12.

$$\frac{di(t)}{dt}$$

therefore corresponds to the change in the amplitude of this current as a function of time.

The electromotive force e(t) arises due to the movement of the coil 12 in the magnetic field of the magnet 14.

For the sake of completeness, the reaction force $f_a$ of the loudspeaker on the connection (ground) can be determined as follows:

$$f_a(t)+d_{12}\dot{x}_1+k_{12}x_1-f_{l12}(t)M=0.$$

Using the equation for the mass oscillator, see above, the result is:

$$m_1\ddot{x}_1(t)+Ap(t)=f_a(t).$$

If the equation for the Lorentz force is inserted into the equation of the mass oscillator, the result is:

$$-m_1\ddot{x}_1-d_{12}\dot{x}_1-k_{12}x_1i(t)Bl_{12}-Ap(t)=0.$$

If the two equations relating to the microphone function are inserted into one another, the result is:

$$L\frac{di(t)}{dt}+Ri(t)-u(t)+Bl_{12}\dot{x}_1(t)=0.$$

The last two equations, represented in the Laplace domain without initial conditions, are as follows:

$$\begin{bmatrix} m_1s^2X_1(s)+d_{12}sX_1(s)+k_{12}X_1(s)=Bl_{12}I(s)-Ap(s) \\ LsI(s)+RI(s)-U(s)+Bl_{12}sX_1(s)=0 \end{bmatrix}$$

The upper line therefore shows the mechanical conditions, while the lower line shows the electrical conditions of the loudspeaker assembly 10. In this case, s is the Laplace variable.

The following applies:

$s=\sigma+j\omega$, wherein i is the imaginary unit with $i^2=-1$, and $\omega=2\pi f$, where f stands for the frequency.

By summarizing, the following results:

$$\begin{bmatrix} \left(m_1s+d_{12}+\frac{k_{12}}{s}\right)sX_1(s)=Bl_{12}I(s)-Ap(s) \\ (Ls+R)I(s)+Bl_{12}sX_1(s)=U(s) \end{bmatrix}$$

The following abbreviations are introduced:

$$m_1s+d_{12}+\frac{k_{12}}{s}(s)\rightarrow Z_m(s)$$

as a mechanical transfer function in the frequency range, $$Ls+R\rightarrow Z_c(s)$$

as an electrical transfer function in the frequency range. The last equation can be transformed as follows:

$$\begin{bmatrix} Bl_{12}I(s)-Z_m(s)sX_1(s)=Ap(s) \\ Z_c(s)I(s)+Bl_{12}sX_1(s)=U(s) \end{bmatrix}$$

This equation represents a system of equations for the two unknowns $sX_1(s)$ and Ap(s) if the two variables I(s) and U(s) are predetermined. In other words, if the current I(s) and the voltage U(s) are known, the sound pressure p(s) or the external force Ap(s) on the diaphragm 16 can be calculated.

Eliminating the relative speed $sX_1(s)$ in the last equation results in:

$$(Bl_{12})^2I(s)-Bl_{12}Z_m(s)[U(s)-Z_c(s)I(s)]=Bl_{12}Ap(s)$$

This equation can be transformed as follows:

$$\frac{Bl_{12}}{Z_m(s)}Ap(s)=\left[Z_c(s)-\frac{(Bl_{12})^2}{Z_m(s)}\right]I(s)-U(s).$$

From the abbreviation $$Z_M(s)=Z_c(s)-\frac{(Bl_{12})^2}{Z_m(s)}$$

follows:

$$\frac{(Bl_{12})^2}{Z_m(s)}=Z_c(s)-Z_M(s).$$

Inserted into the third from last equation:

$$\frac{Z_M(s)-Z_c(s)}{Bl_{12}}Ap(s)=Z_M(s)I(s)-U(s).$$

This equation is shown in FIG. 2 in the form of a signal flow graph. The following consequences can be derived from this:

If a first calibration state is set in which the external force Ap(s) and thus the sound pressure p on the diaphragm 16 is equal to zero, i.e., the diaphragm 16 including the coil 12 with the combined mass $m_1$ is allowed to vibrate freely (pure actuator operation), and if for this free single-mass oscillator the current I(s) flowing into the coil and the voltage U(s) dropping across the coil 12 are measured, the transfer function $Z_M(s)$ can be determined according to $$Z_M(s)=U(s)/I(s).$$

$Z_c(s)$ can be determined by setting a second calibration state in which a movement $sX_1(s)$ of the diaphragm 16 is suppressed. For this purpose, the coil 12 and the magnet 14 are firmly clamped in a fixed position with respect to one another, so that $sX_1(s)$ is equal to zero. Subsequently, the current I(s) flowing into the coil and the voltage U(s) dropping across the coil are then determined again. The transfer function $Z_c(s)$ can be determined from the measured values $$Z_c(s)=U(s)/I(s).$$

The two transfer functions $Z_M(s)$ and $Z_c(s)$ are thus determined. If the current I(s) flowing through the coil and the voltage U(s) dropping across the coil are determined during normal operation, the external sound pressure p(s) can be determined by transforming the above equation $$p(s)=Bl_{12}*(Z_M(s)*I(s)-U(s))/(A(Z_M(s)-Z_c(s)).$$

In other words, by evaluating this equation, the sound pressure p(t) acting on the diaphragm 16 can be determined, although the diaphragm 16 is simultaneously operated in a loudspeaker function. As a result, a microphone function and a loudspeaker function of the loudspeaker assembly 10 are made possible simultaneously.

The invention claimed is:

1. A method for simultaneously operating a loudspeaker assembly in a loudspeaker mode and in a microphone mode, comprising:

operating the loudspeaker assembly, the loudspeaker assembly comprising:

a coil, which is movably mounted in a magnetic field of a magnet that produces a magnetic flux density, the coil having an effective length in the magnetic field, a diaphragm having an area, which is mechanically coupled to the coil, and an external sound pressure acting on the diaphragm in the microphone mode; and determining the external sound pressure acting on the diaphragm in the microphone mode by:

setting a first calibration state, in which the external sound pressure on the diaphragm is equal to zero, and measuring a current flowing into the coil and a voltage dropping across the coil, determining a first transfer function based on the measured current and voltage from the first calibration state, setting a second calibration state in which movement of the diaphragm is suppressed, and measuring a current flowing into the coil and a voltage dropping across the coil, determining a second transfer function based on the measured current and voltage from the second calibration state, measuring the current flowing through the coil and the voltage dropping across the coil during a normal operation, and calculating the external sound pressure on the diaphragm using the magnetic flux density, the effective length of the coil in the magnetic field of the magnet, the first transfer function, the second transfer function, the area of the diaphragm, the current and voltage measured during the normal operation.

2. The method of claim 1, wherein the determining the external sound pressure acting on the diaphragm includes determining according to $$p=(B*l_{12}*(Z_M*I-U))/(A*(Z_M-Z_C)),$$

wherein B is the magnetic flux density generated by the magnet, $l_{12}$ is an effective length of the coil in the magnetic field of the magnet, $Z_M$ is an first transfer function, $Z_C$ is a second transfer function, A is an area of the diaphragm, I for a current measured during the normal operation, and U for a voltage measured during normal operation.

3. The method of claim 1, wherein the determining the first transfer function and the second transfer function include determining a respective frequency dependence of the first transfer function and the second transfer function.

4. The method of claim 1, wherein the measuring the current and the measuring the voltage are performed in a frequency-dependent manner.

5. The method of claim 1, further comprising:

repeating, at predeterminable time intervals, the setting a first calibration state, the determining a first transfer function, the setting a second calibration state, and the determining a second transfer function after the loudspeaker assembly has been installed in an operating environment.

6. A loudspeaker assembly comprising:

a coil that is movably mounted in a magnetic field of a magnet;

a diaphragm that is mechanically coupled to the coil, wherein the magnet is configured to generate a magnetic flux density, the coil having an effective length in the magnetic field, and the diaphragm having an area;

a storage device in which a first transfer function and a second transfer function are stored;

a measuring device configured to measure a current flowing into the coil and a voltage dropping across the coil; and a computing device configured to calculate an external sound pressure on the diaphragm in a microphone mode that is performed simultaneously with a loudspeaker mode of the loudspeaker assembly using the magnetic flux density, the effective length of the coil in the magnetic field of the magnet, the first transfer function, the second transfer function, the area of the diaphragm, the current measured by the measuring device, and the voltage measured by the measuring device.

* * * * *